United States Patent [19]

Dick

[11] 4,232,905

[45] Nov. 11, 1980

[54] TUNNELLING MACHINE

[75] Inventor: Helmut Dick, Spiez, Switzerland

[73] Assignee: Atlas Copco Aktiebolag, Nacka, Sweden

[21] Appl. No.: 25,549

[22] Filed: Mar. 30, 1979

[30] Foreign Application Priority Data

Apr. 4, 1978 [GB] United Kingdom ..... 13172/78

[51] Int. Cl.[3] ..... E21D 9/10

[52] U.S. Cl. ..... 299/31; 299/86; 299/73

[58] Field of Search ..... 299/31, 33

[56] References Cited

U.S. PATENT DOCUMENTS

| | | | |
|---|---|---|---|
| 3,232,670 | 2/1966 | Robbins et al. | 299/56 |
| 3,647,264 | 3/1972 | Lauber | 299/31 |
| 3,663,054 | 5/1972 | Dubois | 299/31 |
| 3,840,271 | 10/1974 | Sugden | 299/31 |
| 4,136,910 | 1/1979 | Plummer | 299/31 |

*Primary Examiner*—Ernest R. Purser

*Attorney, Agent, or Firm*—Frishauf, Holtz, Goodman & Woodward

[57] ABSTRACT

A tunnelling machine has a swing unit (31) that is swingable about a horizontal axis (I). The swing unit has a head (50) that rotates about an axis (II) that is transverse to said horizontal axis and passes the horizontal at a distance below the horizontal axis. The head is equipped with a plurality of disc-cutters (53–58, 63) that are arranged to have their cutting edges on an imaginary sphere with a radius of about the same length as the swing radius. Upon simultaneous upward swinging of the swing unit and rotation of the head, the cutters cut both when on the leading side of the head and when on the trailing side. No cutting occurs during the return swing stroke. When the swing unit has been returned, the machine is advanced a step which is somewhat larger than the distance between the two axes, and another upward cutting stroke can be effected.

10 Claims, 16 Drawing Figures

TUNNELLING MACHINE

BACKGROUND OF THE INVENTION

This invention relates to a tunnelling machine for driving non-circular tunnels. British Pat. Specification No. 1,343,444 discloses a tunnelling machine that has a unit that is swingable about a horizontal axis and is provided with a power rotatable cutter head that cuts solely peripherally by means of drag bits over the entire width of the tunnel. The small tunnel driven has an advantageous non-circular form.

There are many patent specifications showing tunnelling machines for driving tunnels with circular cross-section and having a circular head provided with a large number of free-rolling disc-cutters e.g. U.S. Pat. No. 3,232,670. However, circular tunnels are not always desirable.

In some rock, it is advantageous to use disc-cutters instead of drag bits and attempts have been made to make a tunnelling machine for driving non-circular tunnels by means of disc-cutters, cf. for example U.S. Pat. No. 3,840,271. One disadvantage with such prior art machines is that the advance steps are only of the same magnitude as the cutting depth of disc cutters, so that, if the machine slides backwardly only a little, the advance per hour will be considerably affected.

Another disadvantage is that there will be very few discs in cutting engagement with the rock which makes the advance per hour low.

Accordingly, it is an object of the invention to provide a fast driving tunnelling machine which uses free-rolling cutters to produce a small tunnel of an advantageous shape.

The invention will be described with reference to the accompanying drawings which illustrate by way of example a preferred embodiment of the invention.

DETAILED DESCRIPTION

Figure 1:
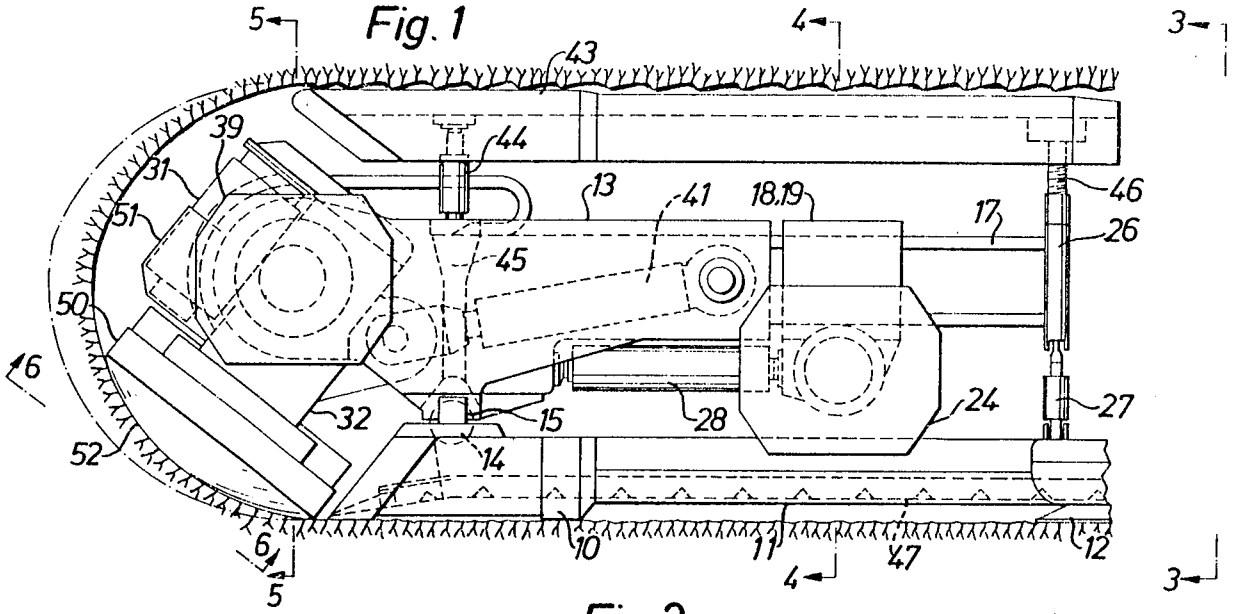
FIG. 1 is a side elevational view of a tunnelling machine.
Figure 2:
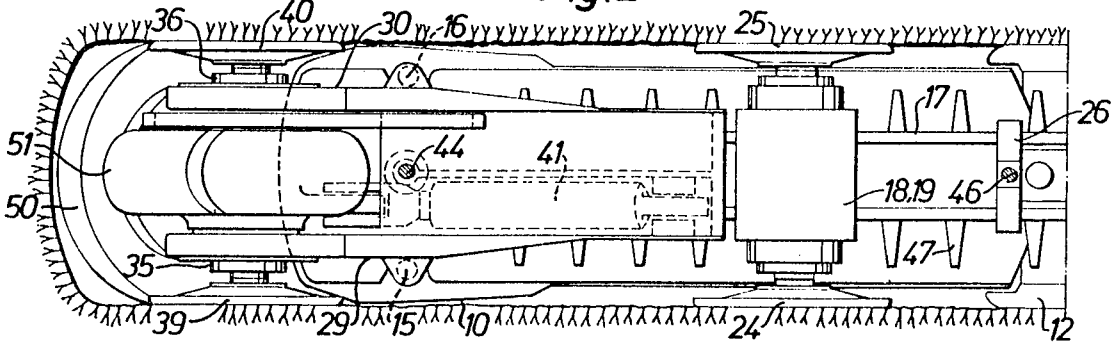
FIG. 2 is a top plan view of the tunnelling machine shown in FIG. 1.
Figure 5:
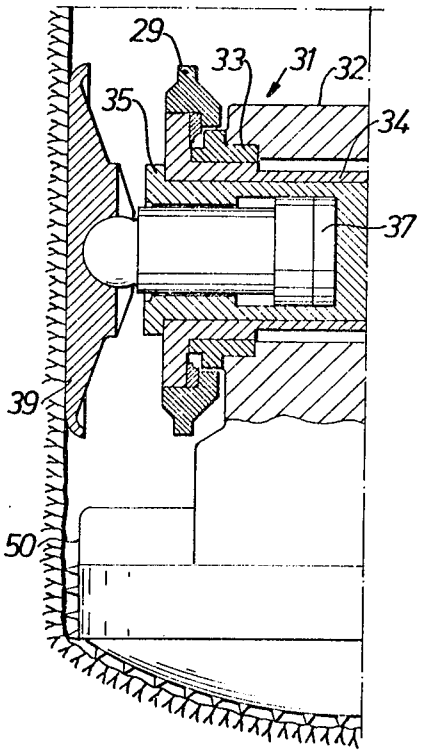
FIG. 5 is a fragmentary section taken along line 5—5 in FIG. 1.

The tunnelling machine illustrated in the figures comprises a front shoe 10 that rests on the tunnel floor with its front end and has a rearwardly extending portion 11 that is pivotably coupled to a rear shoe 12. The rear shoe 12 carries a non-illustrated trailer on which the operator's cabin is mounted. The front shoe 10 carries a main frame 13 by means of a central ball joint 14. Two trimming jacks 15,16 are located one at each side of the ball joint and pivotably coupled between the shoe 10 and the main frame 13 to permit tilting of the main frame 13 laterally. The main frame 13 has a rearwardly extending guide beam 17 on which a guidebox 18 is mounted to be slidable along the beam. The guidebox 18 is part of the housing 19 of an anchoring unit. The housing 19 has a through bore in which two hydraulic jacks 20, 21 are inserted to abut against each other. The jacks 20, 21 have pistons 22, 23 on which gripper pads 24, 25 of steel are mounted by means of ball joints. The guide beam 17 has an end plate 26 and a hydraulic jack 27 is pivotably coupled between the end plate and the rear shoe 12. Vertical steering of the machine can be effected by means of the jack 27, which can tilt the main frame 13 about a transverse substantially horizontal axis provided by the ball joint 14 and the trimming jacks 15, 16. The two jacks 20, 21 of the anchoring unit can be used to effect lateral steering since they can move the housing of the anchoring unit laterally in the tunnel so as to displace the guide bean laterally.

A double acting hydraulic jack 28—the advance jack—is pivotably coupled between the anchoring unit 19 and the main frame 13.

The front part of the main frame is bifurcated into two rigid side plates 29, 30, in which a housing 32 of a swing unit 31 is journalled.

At each side of the swing unit housing 32, a bearing ring 33 is bolted to the housing 32 and it has a bearing surface against a distance tube 34 that extends through the swing unit housing 31 and is bolted to the two side plates 29, 30 of the main frame. Two identical hydraulic jacks 35, 36 are inserted into the distance tube and abut against each other. By means of ball joints, the pistons 37, 38 of the jacks 35, 36 carry gripper pads 39, 40 of steel. The swing unit 31 is swingable about the axis I of the distance tube 34, which is also the axis of the gripper jacks 35, 36. A hydraulic jack 41—the swing jack—is pivotably coupled between pivots mounted on the swing unit housing and on the main frame respectively so that it can swing the swing unit about the axis I.

The front gripper jacks 35, 36 can be used for lateral steering alternatively to the rear gripper jacks 20, 21. When making a sharp curve, both the front gripper jacks 35, 36 and the rear gripper jacks 20, 21 can be used to laterally displace the front end of the machine and the rear end of the machine in opposite directions.

The main frame 13 can be advanced by means of the advance jack 28 when the anchoring unit 19 is braced between the tunnel walls by means of the jacks 20, 21 and pads 24, 25.

The advance jack 28 is also used to pull the anchoring unit 19 forwardly along the guide beam 17 when the anchoring unit is released. The guide beam 17, as shown, is long enough to permit for example three or four normal advance steps before the anchoring unit has to be pulled forwardly.

During operation of the swing unit 31, the main frame 13 is immobilized by both the front gripper pads 39, 40 and the rear gripper pads 24, 25. A roof 43 can also be used to assist in stabilizing the machine in the tunnel.

The front end of the roof 43 is carried by a hydraulic jack 44 that takes support on a strut 45 that is fixed to the main frame 13. The strut 45 rests on the main frame 13 directly on the socket for the ball of the ball joint 14. The rear end of the roof 43 is held by a rigid screw 46 screwed into the end plate 26 of the main frame. Both the jack 44 and the screw 46 are coupled to the roof 43 by means of non-illustrated ball joints.

A flight chain conveyor 47 is located in the shoes 11, 12 to convey the debris away from the tunnel face. The shoes 11, 12 have covers in order to reduce dusting. A suction pipe 48 is located in the roof 43 to suck away dust from the front end of the machine.

The swing unit 31 comprises a head 50 rotatably journalled in the housing 32 of the swing unit so as to be rotatable about an axis II. A motor 51 which can be electric or hydraulic is mounted on the housing 32 of the swing unit 31 and coupled through a non-illustrated gearing inside the housing 32 to the head 50 to rotate the latter. The face 52 of the head 50 is provided with ten free-rolling cutters 53–62. The two conical central cutters 53 and 54 are cone rollers whereas the cutters 55–58 are only slightly conical and the cutters 59–62 are cylindrical. The central cutters 53, 54 are suitably equipped with carbide buttons (non-illustrated). The other cutters 55–62 are shown as having discs with circular edges but they may also have carbide buttons along the edges of their discs. The cutters have preferably two or more discs; in the figures they are shown as having four discs each. Cutters with only one disc can also be used. The four outermost cutters 59–62 have axes of rotation that form with the rotation axis II of the head angles that are smaller than 45°, whereas all the other discs have axes of rotation that form with the rotation axis II of the head angles that exceed 45°. (In the figures, the four outermost cutters 59–62 are shown as having their axes parallel with the axis II.) The discs cutters 55–58 have their discs at consecutive larger distance from the axis II, whereas the discs of the disc cutters 63–65 are located at equal radial distance from the axis II. The cutting parts of the cutters 53–58 lie substantially on a segment of an imaginary sphere so that the face 52 of the head 50 can be schematically represented as this spherical segment in FIGS. 8–11. These figures are longitudinal sections through the center of the tunnel, i.e. through the rotation axis II. The head 50 is also provided with fixed shovels 73 that assist in transporting the debris away from the head.

Figure 8:
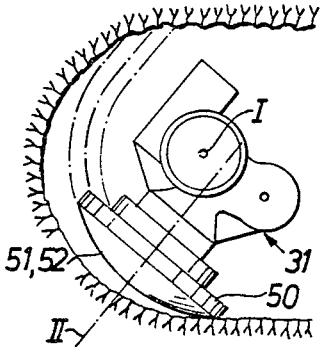
FIGS. 8–11 are fragmentary schematic views showing a swing unit of the machines in various positions during operation.
Figure 9:
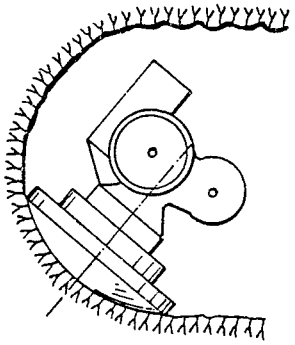
Figure 10:
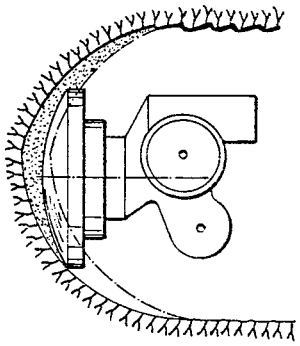
Figure 11:
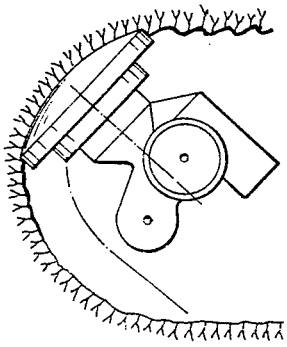

A complete cutting sequence will now be described with reference to FIGS. 8–11. In FIG. 8, the swing unit 31 is shown when swung back after an upward cutting stroke. In FIG. 9, the machine is advanced into position for starting another cutting stroke. In FIG. 10, the swing unit is shown during an upward cutting stroke and the rock to be cut away is shown hatched. In FIG. 11, the swing unit is shown just when the cutting stroke is completed. When the upward cutting stroke is completed, the swing unit is returned to the position shown in FIG. 8. The head is rotated during the entire sequence, i.e. both during the idle return stroke and during the advance step.

Figure 12:
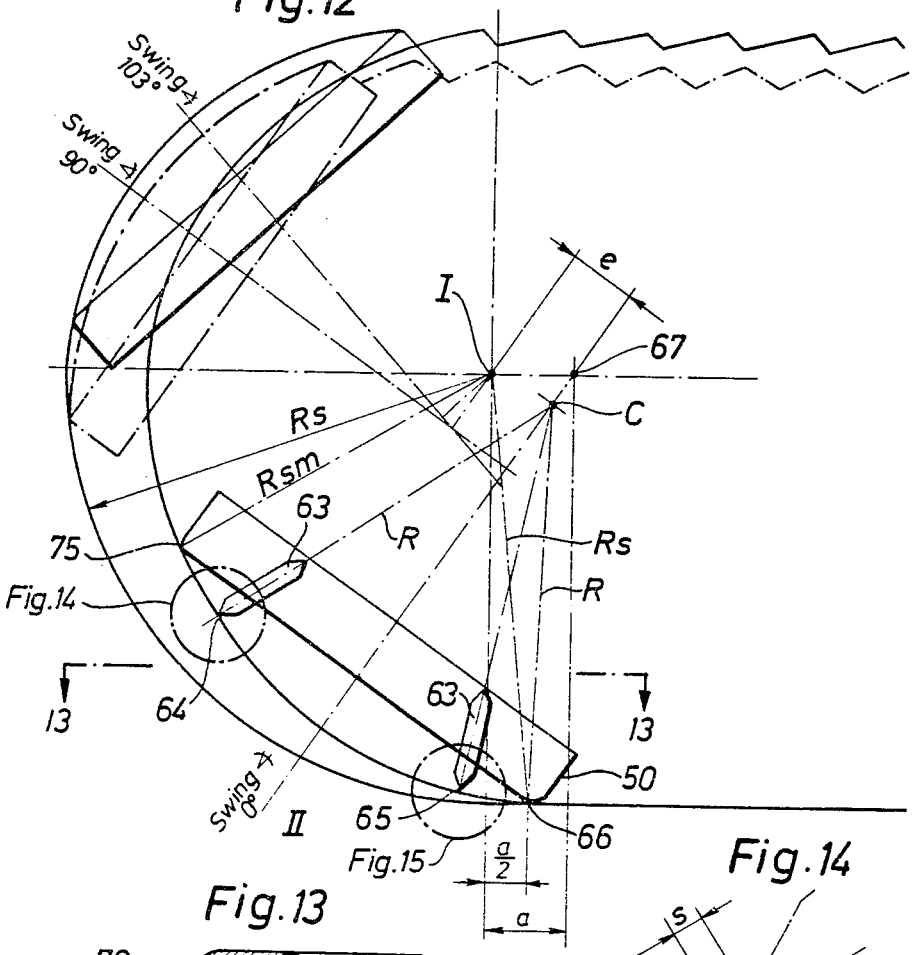
FIG. 12 is a diagrammatic view illustrating the geometrical configuration of a cutting head of the machine.

In FIG. 12 the preferred geometrical configuration of the head 50 is shown very schematically. FIG. 12, too, is a longitudinal section taken through the rotation axis II. The head 50 is shown in its back end position after the machine has been advanced one step, whereas it is shown before the advance step in FIG. 8. The largest swing radius, i.e. the radius from the swing axis I of the swing unit 31 to rear end denoted as point 66 of the face 52 of the head, has been designated Rs. The center of the curvature of the imaginary sphere of the face 52 of the head has been designated C and the radius from the center C to the sphere has been designated R. When the machine is horizontal as when located to drive a horizontal tunnel and the head 50 is in its rear end position, the point of intersection of the rotation axis II with a horizontal plane through the swing axis I has been designated 67. The horizontal distance a between the swing axis I and the point 67 represents an advance step.

Figure 13:
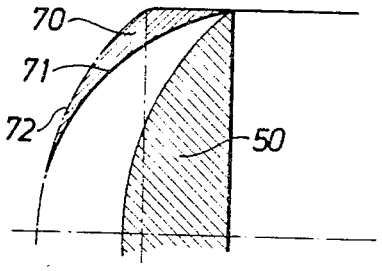
FIG. 13 is a section taken along line 13—13 in FIG. 12.

In this rear end position of the swing unit 31, the rear end point 66 of the face 52 of the head 50 is located in the middle between two parallel vertical planes through the swing axis I and through the point 67 on the rotation axis II respectively. In FIG. 12, the head 50 is shown when the machine frame has been advanced a step from the position of FIG. 8 and as can be seen in FIG. 12, in the central section shown, the face 52 of the head conforms with the tunnel face that was cut in the swinging sequence that preceded the advance step. However, the head had to cut at the laterally outer parts of the tunnel during the advance step of the machine as can be understood from FIG. 13. The parts 70 to be cut away are shown hatched. In FIG. 13, the head is shown before the advance step instead of after the advance step as in FIG. 12. The tunnel profile cut in the preceding swing cut is shown by line 71 and the tunnel profile after the advance step is shown by line 72.

In FIG. 12, two alternative upper end positions of the head 50 are shown. The higher alternative position (shown in full lines) results from swinging of the swing unit 31 through an angle of 103° and the lower alternative position shown in phantom lines results from swinging through 90°. Thus, the height of the tunnel can be preselected.

Figure 4:
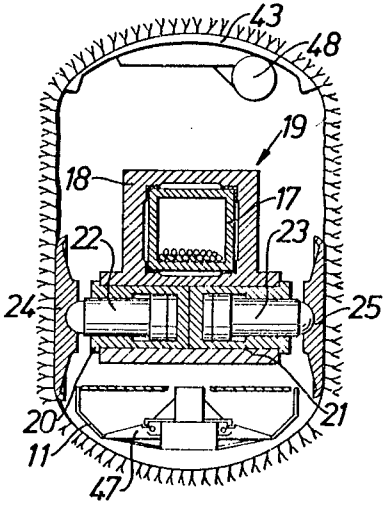
FIG. 4 is a transverse section taken along line 4—4 in FIG. 3.
Figure 3:
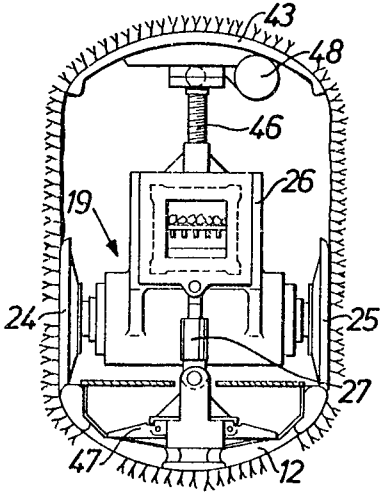
FIG. 3 is a transverse section taken along line 3—3 in FIG. 1.
Figure 6:
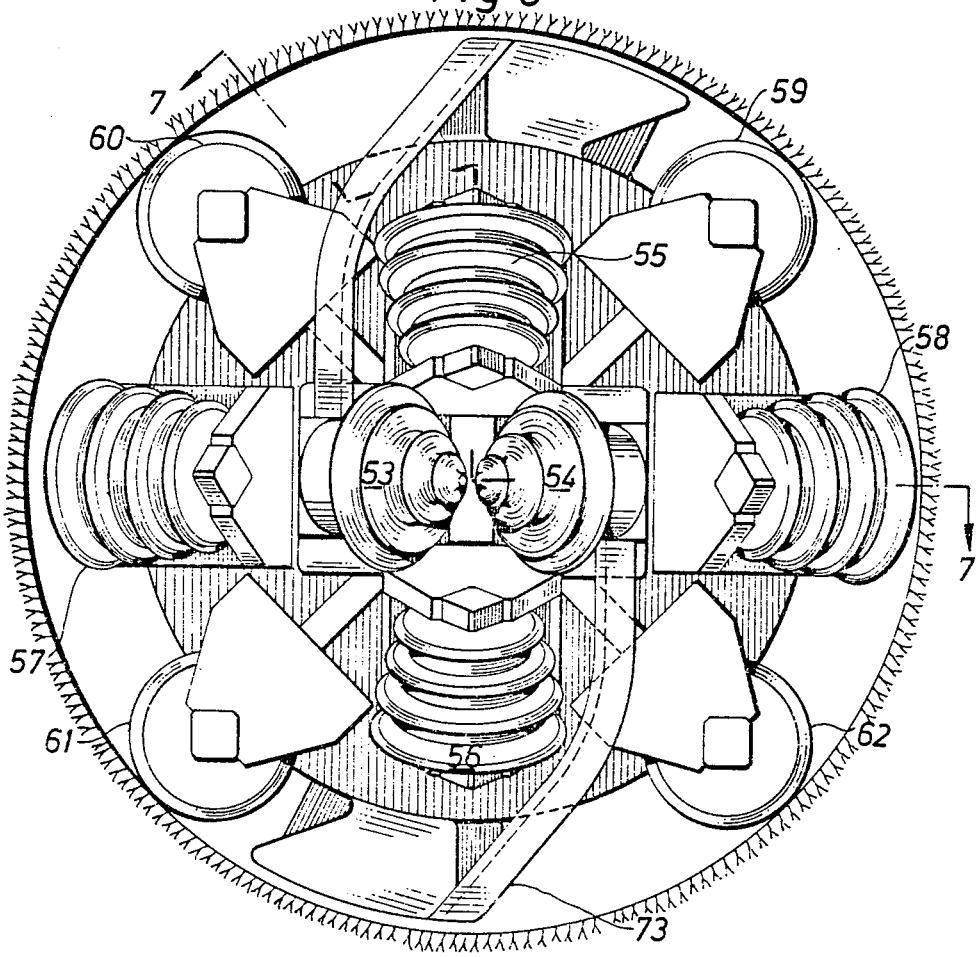
FIG. 6 is a view seen as indicated by lines 6—6 in FIG. 1.
Figure 7:
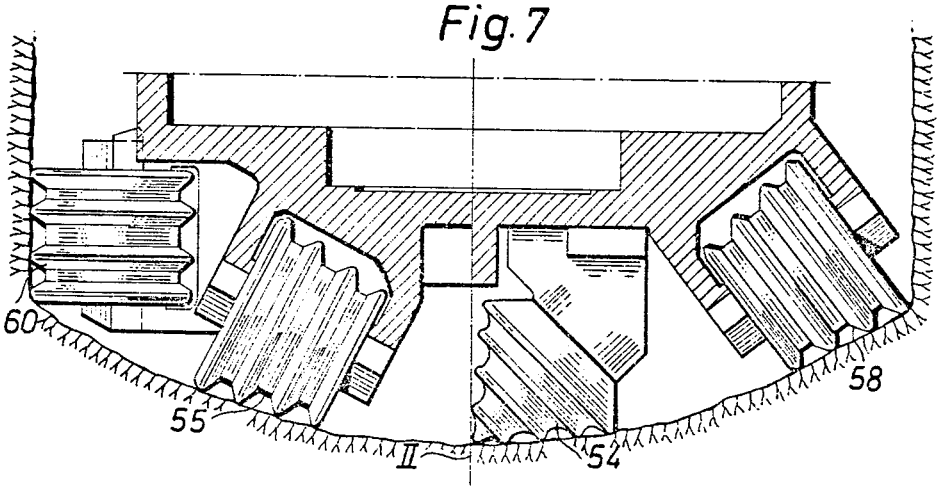
FIG. 7 is a section substantially taken along line 7—7 in FIG. 6.
Figure 14:
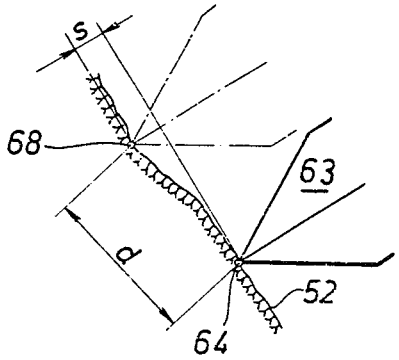
FIGS. 14 and 15 are enlarged fragmentary sections of parts of FIG. 12.
Figure 15:
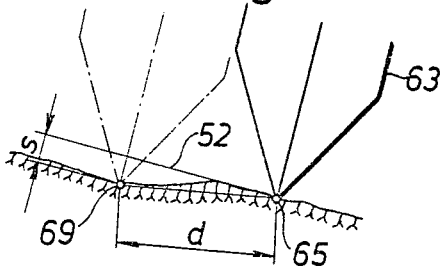
Figure 16:
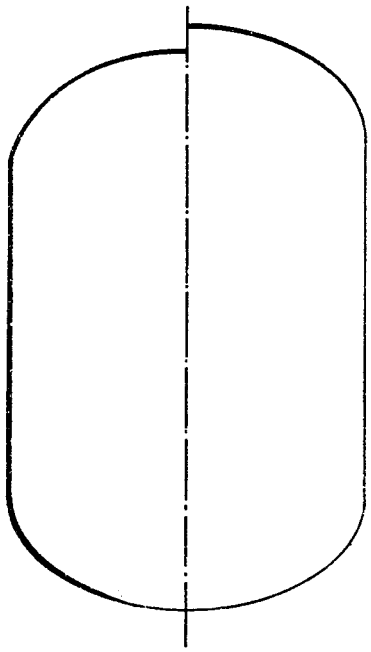
FIG. 16 shows the profile of a tunnel cut by the machine illustrated in the preceding figures.

As can be seen in FIG. 12, the rotation axis II passes the swing axis I at a distance e. The rotation axis II is at the trailing side of the swing axis I as referred to the upward cutting swing stroke, which results in the face 52 of the head cutting progressively into the rock. The radius R of the face 52 is laid out to such a degree that each disc of the cutters 53–58 cuts substantially equally deep all the way during a revolution of the cutter head 50. FIGS. 14 and 15 are enlarged details of FIG. 12, showing the cutting principle of one disc 63, e.g. a disc of the cutter 55. During one revolution of the cutter head 50 the cutter disc 63 moves along a spiral-shaped path. As seen at the leading side of the head 50, the disc 63 moves from a point 64 to a point 68 during a revolution (FIG. 4). As seen at the trailing side of the head, the disc 63 moves from a point 65 to a point 69 (FIG. 15). The pitch of the spiral corresponds to the distance d between the points 64 and 68 as well as between the points 65 and 69. The constant cutting depth of the cutter discs has been designated s. The ratio between d and s is about 4:1. The cutters 59–62, however, cut only on the leading side of the head, and mostly during the upper part of the cutting stroke of the swing unit 31. They cut peripherally with a total cutting depth during one revolution of the cutter head equal to the pitch d in FIGS. 14 and 15. This total cutting depth d is cut by four cutters 59–62. Therefore the effective cutting depth of each cutting disc of the cutters 59–62 is d/4 which is about equal to the cutting depth s in FIGS. 14 and 15. Thus, the load on all cutters 53–62 will be approximately the same. An advance step equal to the distance a between the swing axis I and the point 67 is of the same magnitude as the distance e. As shown in FIG. 12, the advance step is less than 50% larger than the distance e. The distance between the axis I and the point c is almost the same as the distance e. An advance step a is many times larger than the cutting depth of a cutting disc, normally more than ten times larger. In the rear end position of the swing unit 31, the rearmost cutting point 66 of the head 50 is located a distance a/2 behind the swing axis I, this distance being shorter than an advance step a. The largest swing radius Rs is somewhat larger than the radius R whereas the smallest swing radius, i.e. the swing radius to the leading side of the head is somewhat larger than the radius R. The radius R differs less than 25% in length from the largest swing radius Rs and from the smallest swing radius. In other words, the radius R is of the same magnitude as the swing radius. As can be understood from FIG. 12 one advance step is equal to the difference between the maximum swing radius Rs of the cutter 58 (i.e. to the point 66) and the corresponding minimum swing radius Rsm to a point 75.

I claim:

1. A tunnelling machine comprising:

a frame (12, 13), means (20–25, 35–40) for immobilizing the frame in the tunnel, a swingable unit (31) carried by said frame to be swingable about a horizontal first axis (I) that is transverse to the machine and motor means (41) for swinging said swingable unit about said first axis (I), said swingable unit comprising a housing (32), a head (50) rotatably mounted in the housing to be rotatable about a second axis (II) that is transverse to said first axis (I), motor means (51) for rotating the head, and a plurality of free rolling cutters (53–58) mounted on the head in a convex arrangement to form a convex front face of the head, said second axis (II) passing said first axis (I) at a distance and on the trailing side with respect to the head so as to cause the cutters to cut both when they are on the leading side of the head and when they are on the trailing side of the head upon simultaneous rotation of the head and swinging of the swingable unit in a working swing stroke while the frame is fixed in the tunnel by said immobilizing means so as to hold the first axis (I) fixed.

2. A tunnelling machine according to claim 1 in which said second axis (II) passes below said first axis (I) when the second axis is horizontal so that the head (50) will be in position to cut during an upwardly swinging movement of said swingable unit.

3. A tunnelling machine according to claim 1 or 2 in which the cutters (53–58) have cutting parts and are so arranged that their cutting parts lie substantially on a segment of an imaginary sphere.

4. A tunnelling machine according to claim 3 in which the radius (R) of said imaginary sphere differs less than 25 percent in length from the largest swing radius (Rs), i.e. from the largest distance between said second axis (II) and the rock being cut.

5. A tunnelling machine according to claim 3 further comprising cutters (59–62) which are mounted on the periphery of the head (50) to cut circumferentially.

6. A tunnelling machine according to claim 5 in which said peripherally mounted cutters (59–62) are free rolling cutters.

7. A tunnelling machine according to claim 6 in which said peripherally mounted cutters (59–62) have axes of rotation that are substantially parallel with said second axis (II).

8. A tunnelling machine according to claim 1 or 2 further comprising cutters (59–62) which are mounted on the periphery of the head (50) to cut circumferentially.

9. A tunnelling machine according to claim 8 in which said peripherally mounted cutters (59–62) are free rolling cutters.

10. A tunnelling machine according to claim 9 in which said peripherally mounted cutters (59–62) have axes of rotation that are substantially parallel with said second axis (II).

* * * * *